US007085724B2

(12) United States Patent
Den Brinker et al.

(10) Patent No.: US 7,085,724 B2
(45) Date of Patent: Aug. 1, 2006

(54) LINKING IN PARAMETRIC ENCODING

(75) Inventors: Albertus Cornelis Den Brinker, Eindhoven (NL); Arnoldus Werner Johannes Oomen, Eindhoven (NL); Fransiscus Marinus Jozephus De Bont, Eindhoven (NL); Erik Gosuinus Petrus Schuijers, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 813 days.

(21) Appl. No.: 10/046,634

(22) Filed: Jan. 14, 2002

(65) Prior Publication Data

US 2002/0133358 A1 Sep. 19, 2002

(30) Foreign Application Priority Data

Jan. 16, 2001 (EP) ..... 01200144
Jul. 6, 2001 (EP) ..... 01202613

(51) Int. Cl.
*G10L 19/00* (2006.01)
*G10L 19/02* (2006.01)

(52) U.S. Cl. ..... 704/500; 704/265; 704/211; 704/221

(58) Field of Classification Search ..... 704/211, 704/221, 227, 500, 265
See application file for complete search history.

(56) References Cited

U.S. PATENT DOCUMENTS 4,885,790 A 12/1989 McAulay et al. ..... 381/49
4,937,873 A 6/1990 McAulay et al. ..... 381/51
5,504,833 A 4/1996 George et al. ..... 395/2.2

FOREIGN PATENT DOCUMENTS

WO WO8909985 10/1989
WO WO0079519 12/2000

OTHER PUBLICATIONS

J. Nieuwenhuijse, R. Heusdens & RD F. Deprettere, "Robust Exponential Modeling of Audio Signals", Proc. SPS 98, pp. 143-146M Leuve, Belgium, Mar. 26-27, 1998.

(Continued)

*Primary Examiner*—V. Paul Harper

(57) ABSTRACT

The invention relates to a linking unit 100, a parametric encoder 400 and a method for generating linking information L indicating components of consecutive extended segments sp and sc which may be linked together in order to form a sinusoidal track. The segments sp and sc approximate consecutive segments of a sinusoidal audio or speech signal s. The linking unit comprises a calculating unit 120 for generating a similarity matrix S(m,n) in response to received sinusoidal code data and an evaluating unit 140 for receiving and evaluating said similarity matrix S in order to generate said linking information by selecting those pairs of components m,n the similarity of which is maximal. According to the invention the calculating unit 120 is adapted to calculate the similarity matrix S by additionally considering information about the phase consistency between the components of the extended previous segment sp and the extended current segment sc. In that way the selection of components suitable for being linked together is improved resulting in the definition of correct tracks.

16 Claims, 2 Drawing Sheets

OTHER PUBLICATIONS

By R. Mucaulay & T. Quartieri, "Speech Analysis/Synthesis Based on Sinusoidal Representation" IEEE Transaction on Acoustics, Speech Siganl Process., Aug. 4, 1986 vol. 34, pp. 744-754.

By E.B. George & M.J.T. Smith, "A New Speech Coding Model Based on Least-Squares Sinusoidal Representation", Proc. 1987 Int. Conf. Acoustic, Speech Signal Processing. (ICASSP87), pp. 1641-1644, Dallas Texas, Apr. 6-9, 1987, IEEE, Piscataway, NJ.

By M. Goodwin, "Matching Pursuit With Damped Sinusoids", IEEE Int. Conf. Acoustics, Speech Signal Process, vol. 3, pp. 2037-2040, May 1997.

By S.N. Levine, "Audio Representations for Data Compression and Compressed Domain Processing", PhD Thesis, Stanford University, CA, Dec. 1998, p. 47.

By Elder et al. "ASAC-Analysis/Synthesis CODEC for Very Low Bit Rate", Preprint 4179 (F-6) 100$^{th}$ AE9 Convention, Copenhagen May 11-14, 1996, pp. 1-15.

LINKING IN PARAMETRIC ENCODING

The invention relates to a linking unit according to the preamble of claim 1. The linking unit serves for generating linking information indicating components of consecutive (typically overlapping) extended segments sp and sc which may be linked together in order to form a sinusoidal track, the segments sp and sc approximating consecutive segments of a sinusoidal audio or speech signal s.

The invention further relates to a parametric encoder according to the preamble of claim 8 and a method for generating said linking information according to the preamble of claim 9.

In the prior there are known two substantially different approaches for providing the linking information L used to establish sinusoidal tracks over consecutive segments. According to a first approach as described in the WO 00/79519 (PHN 017502 EP.P) partial signals of an original audio or speech signal are reconstructed based on sinusoidal input data including amplitude, frequency and phase information from a previous and a current segment. These reconstructed partial signals are compared with the original audio- or speech signal. The weighted mean-squared error signal was proposed as a criterion to select relevant links, i.e. to generate the linking information L.

This first approach does not only take amplitude and frequency information into account for optimally linking consecutive segments but also considers phase information of the components of the previous and the current segment. However, the drawback of this first approach is its computational burden and the fact that the original signal is required to generate the linking information.

According to a second approach known in the art the linking information is generated by only considering the amplitude and the frequency information from the sinusoidal code data from the current and the previous segment but not their phase information. Said second approach is now described by referring to FIG. 5.

FIG. 5 shows a linking unit 500 as described in the preamble of claim 1. It comprises a calculating unit 520 for generating a similarity matrix S(m,n) in response to received sinusoidal code data Dp', Dc'. Said sinusoidal code data include information about the amplitudes and the frequencies of M components $x_m$ with m=1 . . . M of the extended previous segment sp and of N components $y_n$ with n=1 . . . N of the extended current segment sc. The similarity matrix S(m,n) represents the similarity between the m'th component $X_m$ of said extended previous segment sp and the n'th component $y_n$ of said extended current segment sc for m=1 . . . M and n=1 . . . N. Said similarity matrix S(m,n) is input into an evaluating unit 540 which evaluates said similarity matrix in order to generate said linking information L by selecting those pairs of components m,n the similarity of which is maximal.

Consequently, the linking information L indicates those pairs of components of consecutive extended segments which may be linked together when restoring the audio or speech signal s after storage or transmission such that transitions between consecutive segments or components thereof are as smooth as possible. Smooth transitions lead to an improved quality of the restored signal.

Hereinafter linked components continuing over consecutive segments are referred to as sinusoidal track even if the separate components include slight variations, e.g. amplitude or frequency variations.

An advanced application of that second approach has been described by B. Edler, H. Purnhagen, and C. Ferekidis, in "ASAC-Analysis/synthesis codec for very low bit rates", Preprint 4179 (F-6) 100$^{th}$ AES Convention, Copenhagen, 11–14 May, 1996.

In that article the authors propose a combination of relative distances in frequency and amplitudes as an additional criterion for generating the linking information. Expressed in other words, the linking information indicates if and which components of the previous and the current segment are considered to be local estimates belonging to the same sinusoidal crack.

Advantageously according to the second approach the generation of the linking information is done without considering the original audio or speech signal; however, since generation of the linking information according to the second approach is based on estimated sinusoidal code data only, the generated linking information may be wrong and incorrect tracks may be provided.

Starting from said second approach it is the object of the present invention to further develop a known linking unit, a parametric encoder and a method for generating linking information such that the selection of components of consecutive segments suitable for being linked together is improved resulting in a definition of a correct sinusoidal track.

That object is solved by the subject matter of claim 1. According to the characterising portion of claim 1 enlarged sinusoidal code data shall be provided comprising not only amplitude and frequency information but also information about the phase of at least some of the M components $x_m$ and at least some of N components $y_n$. Further, the calculation unit of a linking unit is adapted to calculate the similarity matrix S(m,n) by additionally considering the phase consistency between m'th component $x_m$ of the extended previous segment sp and the n'th component $y_n$ of the extended current segment sc.

Advantageously, the proposed linking unit does only use estimated sinusoidal code data including phase information for generating the linking information. By additionally considering the phase information a more accurate determination of the similarity matrix and thus, a more reliable—in comparison to the second approach known in the art—determination of the linking information is possible without considering the original audio or speech signal s.

According to a first embodiment the calculating unit comprises a first pattern generating unit for generating said M complex components $x_m(t)$ of the extended previous segment sp and a second pattern generating unit for generating said N complex components $y_n(t)$ of the extended current segment sc. The explicit calculation of these complex and time-dependent components is required according to the invention in order to be able to evaluate the phase consistency between each of said components of the previous and of the current segment.

Advantageously, the calculating module is adapted to calculate the similarity matrix S(m,n) as a product of a first similarity S1 (m,n) representing the similarity in shape and a second similarity matrix S2(m,n) representing the similarity in amplitude between the components m and n. Further, advantageous embodiments of the linking unit are subject matters of the dependent claims 4 to 7.

The object of the invention is further solved by a parametric encoder according to claim 8 and a method for generating linking information according to claim 9. The advantages of the parametric encoder and of the method substantially correspond to the advantages mentioned above by referring to linking unit.

Five figures are accompanying the description, wherein

Before a preferred embodiment of the invention will be described by referring to the figures a preliminary remark is made for providing some background information about the sinusoidal modelling of the signal segments in general.

In sinusoidal modelling, the models are typically of the form (or can be rewritten as such)

$$seg(t) = \sum_{k=1}^{K} \mathcal{R}\{u_k(t)\} \tag{0}$$

where seg is a segment approximating or modelling a segment of a sinusoidal signal s. In these models the segment seg is represented by an extension as given on the right-hand sight of equation (1), wherein R denotes the real part of a complex variable and $u_k$ are the K underlying sinusoidal or sinusoidal-like segment components of the segment seg.

In particular, for a pure first sinusoidal model (extension), the segment's components are $$u_k(t)=A_k e^{j(\omega_k t+\mu)} \tag{1}$$

with $A_k$, $\omega_k$ and $\mu_k$ (real-valued) amplitude, frequency a n d phase, respectively, and $j=\sqrt{-1}$ According to a second model the components of the segment are defined as:

$$u_k(t)=A_k e^{(\sigma_k+j\omega_k)t+j\mu_k} \tag{2}$$

where $A_k$, $\omega_k$ and $\mu_k$ are as in the pure sinusoidal model and an additional parameter $\sigma_k$ appears. $\sigma_k$ is a real parameter which captures amplitude changes within a segment.

A third, more elaborated known model based on polynomial is:

$$\begin{aligned} u_k(t) &= \left\{\sum_{m=0}^{M} b_{k,m} t^m\right\} \exp\left\{j\sum_{n=0}^{N} \phi_{k,n} t^n\right\} \\ &= \left\{\sum_{m=0}^{M} B_{k,m} t^m\right\} \exp\left\{j\sum_{n=0}^{N} \phi_{k,n} t^n\right\} \end{aligned} \tag{3}$$

with real parameters $b_{k,m}$ and $\Phi_{k,n}$ or complex amplitudes $B_{k,m}=b_{k,m}e^{j\Phi_{k,0}}$ Finally, according to a fourth model, the components of the segments are defined as:

$$u_k(t) = \sum_{m=0}^{M} C_{k,m} t^m \exp\left\{\sum_{n=1}^{N} \theta_{k,n} t^n\right\} \tag{4}$$

with real parameters $\theta_{k,n}$ and complex parameters $C_{k,m}$.

If two consecutive signal segments $s_p$ and $s_c$ (previous and current segment, respectively) are considered then there is typically an overlap in their support. Hereinafter $u_k$ in the previous segment is denoted by $x_m$ (m=1, . . . , M) and $u_k$ in the current segment is denoted by $y_n$(n=1, . . . , N). In order that profitable (in a coding sense) links are established, it seems reasonable to speak of a link between a component m from $s_p$ and a component n from $s_c$ only if $x_m(t)$ and $y_n(t)$ are similar within the overlap area.

In the following preferred embodiments of the invention will be described by referring to FIGS. 1 to 4.

Figure 1:
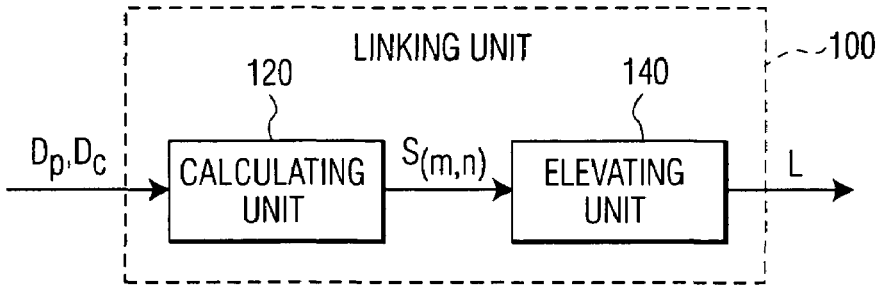
FIG. 1 shows a linking unit according to the invention.
Figure 5:
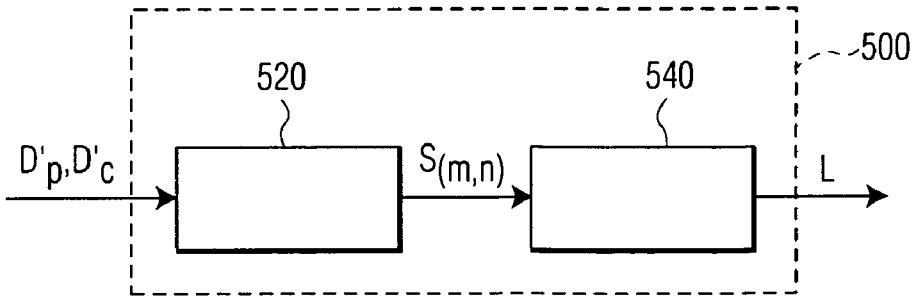
FIG. 5 PRIOR ART
FIG. 5 shows a linking unit known in the art.

FIG. 1 shows a linking unit 100 according to the present invention. It comprises a calculating unit 120 for generating a similarity matrix S(m,n) and an evaluating unit 140 for generating linking information L. The operation of the calculating unit 120 substantially corresponds to the operation of the calculating unit 520 and the operation of the evaluating unit 140 substantially corresponds to the operation of the evaluating unit 540 known in the art and described above by referring to FIG. 5. However, there are the following differences between the operation of the linking unit 100 according to the invention and the linking unit 500 known in the art.

The calculating unit 120 does not only receive sinusoidal code data in the form of amplitude and frequency data of the previous and the current segment but receives enlarged sinusoidal code data further comprising information about the phase of all of the components $x_m$ of the previous segment sc and each of the N components $y_n$ of the current segment sc.

Consequently, the calculating unit 120 is adapted to calculate the similarity matrix S(m,n) not only by considering the amplitude and frequency data but additionally by considering the phase consistency between the m'th component $x_m$ of the extended previous segment sp and the n'th component $y_n$ of the extended current segment sc for m=1 . . . M and n=1 . . . N. The evaluating unit 140 receives and evaluates the similarity matrix S(m,n) output from said calculating unit 120 in order to generate said linking information L by selecting those pairs of components (m,n) the similarity of which is maximal.

Figure 2:
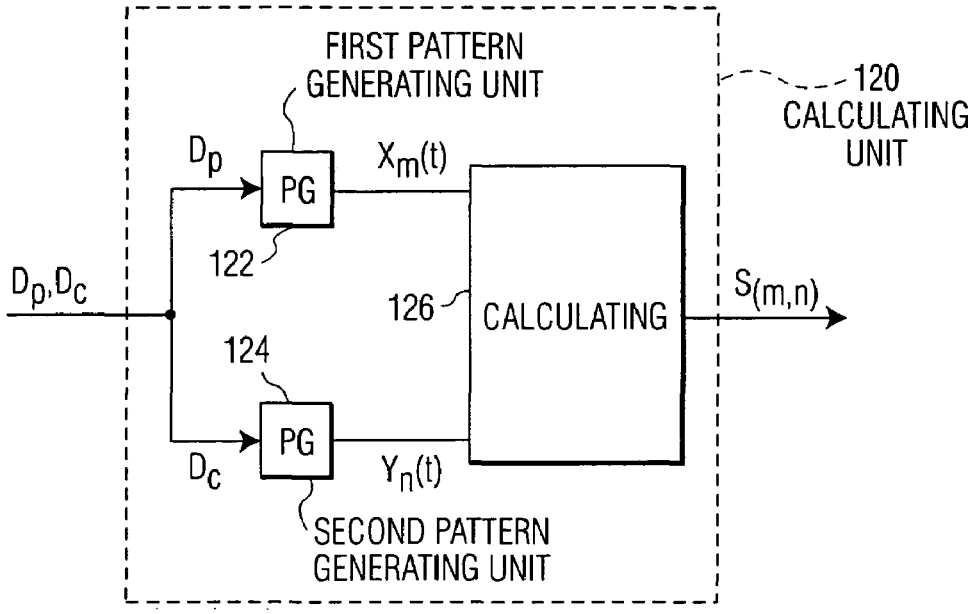
FIG. 2 shows a more detailed illustration of a calculating unit of the linking U unit according to FIG. 1.

FIG. 2 shows a detailed illustration of the calculating unit 120 according to the invention. It can be seen that the calculating unit 120 comprises a first pattern generating unit 122 for generating said M components $x_m(t)$ with m=1 . . . M of the extended previous segment sp in response to the previous segment's enlarged sinusoidal code data (Dp). Further, the calculating unit 120 comprises a second pattern generating unit 124 for generating said N components $y_n(t)$ with n=1 . . . N of the extended current segment $s_c$ in response to the current segment s enlarged sinusoidal code data (Dc). Finally, the calculating unit 120 comprises a calculating module 126 for calculating the similarity matrix S(m,n) on the basis of said received M components $x_m(t)$ and of said received N components $y_n(t)$ according to a predefined similarity measure. Examples for the similarity measure are given below.

The components $x_m(t)$ and $y_n(t)$ are explicitly generated and input to the calculation module 126 in order to determine the phase consistency between two components m and n and to use that phase consistency information for calculating the similarity matrix.

In the following two embodiments of the invention will be described for carrying out the calculation of the similarity matrix S(m,n). Both embodiments have in common that the similarity matrix is preferably but not necessarily calculated by multiplying a first similarity matrix $S_1$(m,n) representing the similarity in shape between the two components m and n with a second similarity matrix $S_2(m,n)$ representing the similarity in amplitude between said components m and n. Then the similarity matrix is calculated according to:

$$S(m,n)=S_1(m,n)S_2(m,n). \tag{5}$$

S(m,n)=0 means that there is no link and the larger S(m,n) is, the more likely it is that this can be exploited profitably as a link in a sinusoidal coding scheme.

The first embodiment for calculating the similarity matrix S is based on the consideration of the similarity of the previous and the current segment within a complete overlapping area. The aim of said first embodiment is to identify components of the previous and the current segment which are similar. This can be done by a correlation method. Thus, according to the first embodiment a correlation coefficient $\rho_{m,n}$ is defined by $$\rho_{m,n} = \frac{\sum_t w(t)x_m(t)y_n^*(t)}{\sqrt{E_{xm}E_{yn}}} \tag{6}$$

where $x_m$(m=[1,M]) represents a set of components $x_m$ of the previous segment $S_p$ and $y_n$(n=[1,N]) represents the set of components $y_n$ of the current segment $s_c$. Further, w(t) represents a window function and $E_{xm}$ represents the energy in the signal $x_m$ according to:

$$E_{xm} = \sum_t w(t)x_m(t)x_m^*(t) \tag{7a}$$

Analogously, $E_{yn}$ represents the energy in the component $y_n$ according to $$E_{yn} = \sum_t w(t)y_n(t)y_n^*(t) \tag{7b}$$

Consequently, $\rho_{m,n}$ is a complex number which, for a link, should be close to 1. Therefore, the first similarity matrix $S_1(m,n)$ is built as a (partial) similarity measure by:

$$S_1(m,n) = \begin{cases} 1-|\rho_{m,n}-1|/D_1, & \text{if } |\rho_{m,n}-1| < D_1, \\ 0, & \text{elsewhere} \end{cases} \tag{8}$$

with $0<D_1<1$.

Additionally, the equivalence in amplitude (or, more particular, in energy) can be taken into account by considering:

$$R_{m,n} = \min\left\{\frac{E_{xm}}{E_{yn}}, \frac{E_{yn}}{E_{xm}}\right\}. \tag{9}$$

gain, for a link, R should be a value close to 1 (in contrast to $\rho_{m,n}$ $R_{m,n}$ is real-valued) and as similarity measure can act $S_2(m,n)$ defined by $$S_2(m,n) = \begin{cases} 1-(1-R_{m,n})/D_2, & \text{if } (1-R_{m,n}) < D_2, \\ 0, & \text{elsewhere} \end{cases} \tag{10}$$

with $0<D_2<1$.

f the previous segment sp is represented by M components and if the current segment sc is represented by N components the first matrix $S_1$ and the second matrix $S_2$ as well as the overall similarity matrix S are M×N matrices. The entries of said matrix S establish if there exist links and, if so, which are the most profitable ones. The most profitable ones are the ones the similarity values of which are maximal. This evaluation of the similarity matrix S(m,n) is done in the evaluating unit 140.

he second embodiment of the invention for calculating the similarity matrix S represents a simplification of the first embodiment. More specifically, not the whole overlapping region between the consecutive segment but only the mid point of said region is considered. At this point, hereinafter referred to as sample $t_0$, it is $$x_m(t_0)\approx y_n(t_0) \tag{11}$$

In that second embodiment it is appreciated that in the neighbourhood of to the components are matched as well. This is realised if the progression (the stride) in the components is (nearly) the same. This is preferably evaluated by the ratio of the components of the two consecutive segments $s_p$ and $s_c$ according to $$\frac{x_m(t_0+1)}{x_m(t_0)} \approx \frac{y_n(t_0+1)}{y_n(t_0)} \tag{12}$$

In order to select links the first (partial) similarity matrix is now defined as:

$$S_1(m.n) = \begin{cases} 1-\left|\frac{x_m(t_0)}{y_m(t_0)}-1\right|\Big/D_3, & \text{if } \left|\frac{x_m(t_0)}{y_n(t_0)}-1\right| < D_3 \\ 0, & \text{elsewhere} \end{cases} \tag{13}$$

with $0<D_3<1$.

Here, the amplitude similarity is involved in a relative way. This agrees with psycho-acoustic relevance and distance criteria.

The second partial similarity matrix $S_2$ is defined as:

$$S_2(m,n) = \begin{cases} 1-\left|\frac{x_m(t_0+1)}{x_m(t_0)}\frac{y_n(t_0)}{y_n(t_0+1)}-1\right|\Big/D_4, \\ \text{if } \left|\frac{x_m(t_0+1)}{x_m(t_0)}\frac{y_n(t_0)}{y_n(t_0+1)}-1\right| < D_4 \\ 0, \quad \text{elsewhere} \end{cases} \tag{14}$$

with $0<D_4<1$.

The second embodiment for calculating the overall similarity matrix S differs from the first embodiment in that the components $x_m$ and $y_n$ need only to be generated at specific instances, namely $t_0$ and $t_0+1$.

Figure 3:
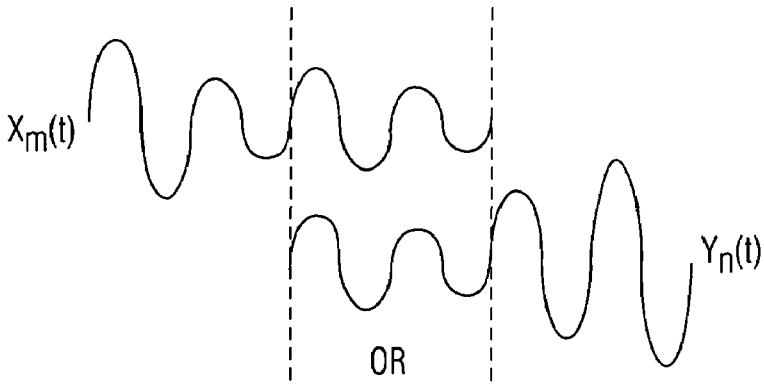
FIG. 3 illustrates the similarity of two components of two consecutive segments.

FIG. 3 illustrates the operation of the linking unit of the present invention. It is shown that a component $x_m(t)$ of a previous segment $s_p$ at least partially overlaps with a component $y_n(t)$ of a consecutive current segment $s_c$ in an overlap region OR. The calculation unit 120 and in particular the calculating module 126 are adapted to analyze the similarity between these two components within the overlap region. If the two components are identical at least within said overlap region as shown in FIG. 3 the corresponding entry in the similarity matrix S(m,n) would be set to one or at least close to one. The amplitude, frequency and phase similarity would be recognised and evaluated by the evaluating unit 140 with the result that the linking information L generated by said evaluating unit 140 in FIG. 1 would indicate that these two components are local estimates belonging to the same sinusoidal track.

Figure 4:
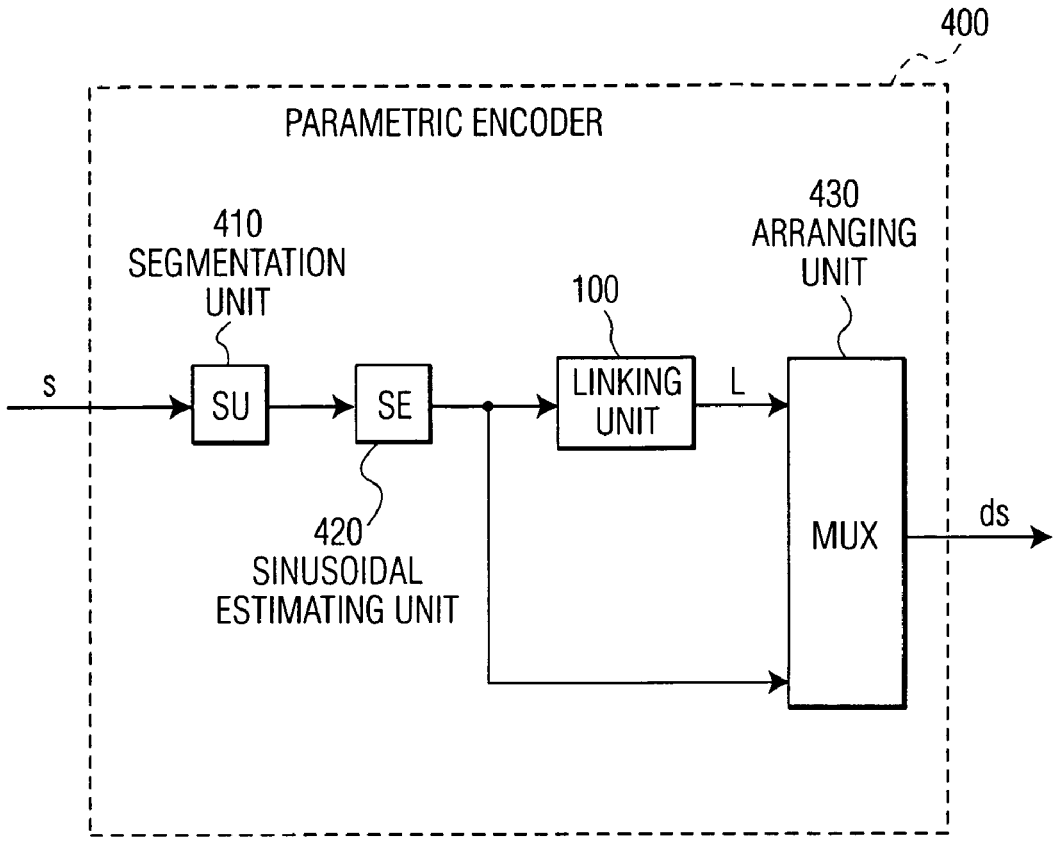
FIG. 4 shows a parametric encoder according to the present invention.

FIG. 4 shows a parametric encoder 400 according to the present invention. Said encoder serves for encoding an audio- and/or speech signal s into a data stream ds including sinusoidal code data and linking information. The encoder 400 comprises a segmentation unit 410 for segmenting said signal s into at least a previous segment sp' and a consecutive current segment sc'. The encoder 400 further comprises a sinusoidal estimating unit 420 for generating said sinusoidal code data in the form of frequency, amplitude and phase data of M components $x_m$ with m=1 . . . M of an extended previous segment sp approximating said segment sp' and of N components $y_n$ with n=1 . . . N of an extended current segment sc approximating said segment sc'. Said sinusoidal code data output from said sinusoidal estimating unit 420 is input to the linking unit 100 as described above by referring to FIG. 1 for generating the linking information L. Said linking information is input into an arranging unit 430 for generating the data stream by appropriately arranging or mixing, e.g. multiplexing the sinusoidal code data output from said sinusoidal estimating unit 420 with said linking information. The arranging unit 430 is preferably embodied as multiplexer.

For real audio signals it has been noted that taken in phase information improves the quality of the coded material. However, in the encoder 400 the phase information is used only if a continuation of a track parametric is searched. If a frequency from the data of the previous frame does not have a backward connection (i.e., it is not yet a track but may, after linking with the current frame date, become the start of a track) then the phase information is used but relayed on the previous linking procedures based on frequency and amplitude data only. The reason for this is that at the start of the track the phase is usually not well-defined. This means that the linking information of the previous segment sp is input to the calculating module 126 in FIG. 3 for steering purposes.

Instead of looking at (relative) differences between complex values $x_m$ and $y_m$, also the real and imaginary parts or amplitudes and phases can be looked at and can be used to construct the similarity criterion. This has the advantage that instead of the two parameters that control the above given similarity measure, one or more parameter per considered variable is received. Therefore, expressed in real parameters instead of complex ones, it typically ends up with twice as many parameters. E.g., splitting the complex signals into amplitudes and phases has the interesting property that it is easier that the similarity measure for the phases can be made frequency-dependent.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word 'comprising' does not exclude the presence of other elements or steps than those listed in a claim. The invention can be implemented by means of hardware comprising several distinct elements, and by means of a suitably programmed computer. In a device claim enumerating several means, several of these means can be embodied by one and the same item of hardware. The mere fact that certain measures are recited in mutually different dependent claims does not indicate that a combination of these measures cannot be used to advantage.

The invention claimed is:

1. A linking unit (100) for generating linking information L indicating components of two consecutive extended segments sp and sc which partially overlap and which may be linked together in order to form a sinusoidal track, the segments sp and sc approximating consecutive segments of a sinusoidal audio or speech signal s, the linking unit comprising:

a calculating unit (120) for generating a similarity matrix S(m,n) in response to received sinusoidal code data including information about the amplitudes and the frequencies of M components $x_m$ with m=1 . . . M of the extended previous segment sp and of N components $y_n$ with n=1 . . . N of the extended current segment sc, wherein the values of said similarity matrix represent the similarity between the m'th component $x_m$ of said extended previous segment sp and the n'th component $y_n$ of said extended current segment sc for m=1 . . . M and n=1 . . . N; and an evaluating unit (140) for receiving and evaluating said similarity matrix S(m,n) in order to generate said linking information L by selecting those pairs of components (m,n) the similarity of which is maximal at least within the an overlapping region;

characterised in that the sinusoidal code data (Dp, Dc) is enlarged by further comprising information about the phase of at least some of the M components $x_m$ and at least some of the N components $y_n$;

the calculating unit (120) is adapted to calculate the similarity matrix S(m,n) by additionally evaluating the phase consistency between the m'th component $x_m$ of the extended previous segment sp and the n'th component $y_n$ of the extended current segment sc.

2. The linking unit according to claim 1, characterised in that the calculating unit comprises:

a first pattern generating unit (122) for generating said M components $x_m(t)$ with m=1 . . . M of the extended previous segment spin response to the previous segment's enlarged sinusoidal code data (Dp);

a second pattern generating unit (124) for generating said N components $y_n(t)$ with n=1 . . . N of the extended current segment sc in response to the current segment's enlarged sinusoidal code data (Dc); and a calculation module (126) for calculating the similarity matrix S(m,n) on the basis of said received M components $x_m(t)$ and of said received N components $y_n(t)$ according to a predefined similarity measure.

3. The linking unit according to claim 2, characterised in that the calculating module (126) is adapted to calculate the overall similarity matrix S(m,n) according to:

$$S(m,n)=S_1(m,n)S_2(m,n)$$

wherein the first similarity matrix $S_1(m,n)$ represents the similarity in shape and the second similarity matrix $S_2(m,n)$ represents the similarity in amplitude or energy between the components m and n.

4. The linking unit according to claim 3, characterised in that the similarity $S_1(m,n)$ is defined according to:

$$S_1(m,n)=\begin{cases}1-|\rho_{m,n}-1|/D_1, & \text{if } |\rho_{m,n}-1|<D_1,\\ 0, & \text{elsewhere}\end{cases}$$

with 0<D1<1 and with $$\rho_{m,n}=\frac{\sum_t w(t)x_m(t)y_n^*(t)}{\sqrt{E_{xm}E_{yn}}}$$

wherein:

$\rho_{m,n}$: is the similarity measure being a cross-correlation coefficient representing the similarity in shape between components $x_m(t)$ and $y_n(t)$;

w(t): is a window function;

$y^*_m(t)$: is the complex-conjugate component $y_m(t)$;

$E_{xm}$: is the energy in the signal $x_m$ with:

$$E_{xm}=\sum_t w(t)x_m(t)x_m^*(t);$$

$E_{yn}$: is the energy in the signal $y_n$ with:

$$E_{yn}=\sum_t w(t)y_n(t)y_n^*(t).$$

5. The linking unit according to claim 4, characterised in that the second similarity $S_2(m,n)$ is defined according to:

$$S_2(m,n)=\begin{cases}1-(1-R_{m,n})/D_2, & \text{if } (1-R_{m,n})<D_2,\\ 0, & \text{elsewhere}\end{cases}$$

with 0<D2<1 and wherein $$R_{m,n}=\min\left\{\frac{E_{xm}}{E_{yn}},\frac{E_{yn}}{E_{xm}}\right\}.$$

6. The linking unit according to claim 3, characterised in that the calculating module (126) is adapted to calculate the first similarity matrix $S_1(m,n)$ according to:

$$S_1(m.n)=\begin{cases}1-\left|\frac{x_m(t_0)}{y_m(t_0)}-1\right|\Big/D_3, & \text{if } \left|\frac{x_m(t_0)}{y_n(t_0)}-1\right|<D_3\\ 0, & \text{elsewhere}\end{cases}$$

with 0<D3<1.

7. The linking unit according to claim 6, characterised in that the calculating module (126) is adapted to calculate the second similarity matrix $S_2(m,n)$ according to:

$$S_2(m,n)=\begin{cases}1-\left|\frac{x_m(t_0+1)}{x_m(t_0)}\frac{y_n(t_0)}{y_n(t_0+1)}-1\right|\Big/D_4, & \text{if } \left|\frac{x_m(t_0+1)}{x_m(t_0)}\frac{y_n(t_0)}{y_n(t_0+1)}-1\right|<D_4\\ 0, & \text{elsewhere}\end{cases}$$

with 0<D4<1.

8. The linking unit according to claim 3, characterised in that the similarity $S_1(m,n)$ is defined according to:

$$S_1(m,n)=\begin{cases}1-|\rho_{m,n}-1|/D_1, & \text{if } |\rho_{m,n}-1|<D_1,\\ 0, & \text{elsewhere}\end{cases}$$

with 0<D1<1 and with $$\rho_{m,n}=\frac{\sum_t w(t)x_m(t)y_n^*(t)}{\sqrt{E_{xm}E_{yn}}}$$

wherein:

$p_{m,n}$: is the similarity measure being a cross-correlation coefficient representing the similarity in shape between components $x_m(t)$ and $y_n(t)$;

w(t): is a window function;

$y^*_m(t)$ is the complex-conjugate component ym(t);

$E_{xm}$: is the energy in the signal $x_m$ with:

$$E_{xm}=\sum_t w(t)x_m(t)x_m^*(t);$$

$E_{yn}$: is the energy in the signal $y_n$ with:

$$E_{yn}=\sum_t w(t)y_n(t)y_n^*(t).$$

9. The linking unit according to claim 8, wherein the second similarity $S_2(m,n)$ is defined according to:

$$S_2(m,n)=\begin{cases}1-(1-R_{m,n})/D_2, & \text{if } (1-R_{m,n})<D_2,\\ 0, & \text{elsewhere}\end{cases}$$

with 0<D2<1 and wherein $$R_{m,n}=\min\left\{\frac{E_{xm}}{E_{yn}},\frac{E_{yn}}{E_{xm}}\right\}.$$

10. Parametric encoder (400) for encoding an audio- and/or speech signal s into a datastream including sinusoidal code data and linking information L, the encoder comprising:

a segmentation unit (410) for segmenting said signal a into at least a previous segment sp' and a consecutive partially overlapping current segment sc';

a sinusoidal estimating unit (420) for generating said sinusoidal code data in the form of frequency and amplitude data of M components $x_m$ with m=1 . . . M of an extended previous segment sp approximating said segment sp' and of N components $y_n$ with n=1 . . . N of an extended current segment sc approximating said segment sc';

a calculating unit (120) for generating a similarity matrix S(m,n) in response to said received sinusoidal code data wherein the values of said similarity matrix represent the similarity between the m'th component $x_m$ of said extended previous segment sp and the n'th component $y_n$ of said consecutive extended current segment scform=1 . . . M and n=1 . . . N;

an evaluating unit (140) for receiving and evaluating said similarity matrix S(m,n) in order to generate said linking information L indicating those pairs of components m1n the similarity of which is maximal;

an arranging unit (430) for generating the datastream representing the original audio- or speech signal by appropriately arranging said amplitude, frequency and linking information;

characterised in that the sinusoidal code data estimating unit (420) is adapted to further generate information about the phase of at least some of the M components $x_m$ and of at least some of the N components $y_n$; and the calculation unit (120) is adapted to calculate the similarity matrix S(m,n) by additionally considering the phase consistency between the m'th component $x_m$ of the extended previous segment sp and the n'th component $y_n$ of the extended current segment sc.

11. A method for generating linking information L indicating components of consecutive partially overlapping extended segments sp and sc which may be linked together in order to form a sinusoidal track, the segments sp and so approximating consecutive segments of a sinusoidal audio-/or speech signal a, the method comprising the steps of:

providing sinusoidal code data including information about the amplitudes and the frequencies of M components $x_m$ with m=1 . . . M of the extended previous segment sp and of N components $y_n$ with n=1 . . . N of the extended current segment sc;

calculating the similarity matrix S(m,n) according to a predetermined similarity measure wherein the similarity matrix represents the similarity between the m'th component $x_m$ of said extended previous segment sp and the n'th component $y_n$ of said extended current segment sc for m=1 . . . M and n=1 . . . N; and evaluating said similarity matrix S(m,n) in order to generate said linking information L by selecting those pairs of components m and n the similarity of which is maximal;

characterised in that the step of providing the sinusoidal code data further includes the provision of information about the phase of at least some of the M components $x_m$ and of at least some of the N components $y_n$; and the similarity matrix S(m,n) is calculated by additionally considering the phase consistency between the n'th component $y_n$ of the extended previous segment sp and the m'th component $x_m$ of the extended current segment sc.

12. A linking unit adapted to link information L indicating components of two consecutive extended segments sp and sc which partially overlap and which may be linked together in order to form a sinusoidal track, the segments ap and sc approximating consecutive segments of a sinusoidal audio or speech signal s, the linking unit comprising:

a calculating unit adapted to generate a similarity matrix S(m,n) in response to received sinusoidal code data including information about the amplitudes and the frequencies of M components $x_m$ with m=1 . . . M of the extended previous segment sp and of N components $y_n$ with n=1 . . . N of the extended current segment sc, wherein the values of the similarity matrix represent the similarity between the m'th component $x_m$ of the extended previous segment sp and the n'th component $y_n$ of the extended current segment sc for m=1 . . . M and n=1 . . . N; and an evaluating unit for receiving and evaluating the similarity matrix S(m,n) in order to generate the linking information L by selecting those pairs of components (m,n) the similarity of which is maximal at least within the an overlapping region;

wherein the sinusoidal code data (Dp, Dc) is enlarged by further comprising information about the phase of at least some of the M components $x_m$, and at least some of the N components $y_n$; and wherein the calculating unit is adapted to calculate the similarity matrix S(m,n) by additionally evaluating the phase consistency between the m'th component $x_m$ of the extended previous segment sp and the n'th component $y_n$ of the extended current segment sc.

13. The linking unit according to claim 12, wherein the calculating unit comprises:

a first pattern generating unit for generating the M components $x_m(t)$ with m=1 . . . M of the extended previous segment spin response to the previous segment's enlarged sinusoidal code data (Dp);

a second pattern generating unit for generating the N components $y_n(t)$ with n=1 . . . N of the extended current segment sc in response to the current segment's enlarged sinusoidal code data (Dc); and a calculation module for calculating the similarity matrix S(m,n) on the basis of the received M components $x_m(t)$ and of the received N components $y_n(t)$ according to a predefined similarity measure.

14. The linking unit according to claim 13, wherein the calculating module is adapted to calculate the overall similarity matrix S(m,n) according to:

$$S(m,n)=S_1(m,n)S_2(m,n)$$

wherein the first similarity matrix $S_1(m,n)$ represents the similarity in shape and the second similarity matrix $S_2(m,n)$ represents the similarity in amplitude or energy between the components m and n.

15. The linking unit according to claim 14, wherein that the calculating module is adapted to calculate the first similarity matrix $S_1(m,n)$ according to:

$$S_1(m,n)=\begin{cases}1-\left|\frac{x_m(t_0)}{y_m(t_0)}-1\right|\Big/D_3, & \text{if } \left|\frac{x_m(t_0)}{y_n(t_0)}-1\right|<D_3\\ 0, & \text{elsewhere}\end{cases}$$

with 0<D3<1.

16. The linking unit according to claim 15, wherein the calculating module is adapted to calculate the second similarity matrix $S_2(m,n)$ according to:

$$S_2(m,n)=\begin{cases}1-\left|\frac{x_m(t_0+1)}{x_m(t_0)}\frac{y_n(t_0)}{y_n(t_0+1)}-1\right|\Big/D_4, & \text{if } \left|\frac{x_m(t_0+1)}{x_m(t_0)}\frac{y_n(t_0)}{y_n(t_0+1)}-1\right|<D_4\\ 0, & \text{elsewhere}\end{cases}$$

with 0<D4<1.

* * * * *